US011441371B2

(12) United States Patent
Fripp et al.

(10) Patent No.: US 11,441,371 B2
(45) Date of Patent: Sep. 13, 2022

(54) 3D PRINTED BARREL SLIP

(71) Applicant: Halliburton Energy Services, Inc., Houston, TX (US)

(72) Inventors: Michael Linley Fripp, Carrollton, TX (US); Terapat Apichartthabrut, Plano, TX (US); Robert Travis Murphy, Van Alstyne, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/132,924

(22) Filed: Dec. 23, 2020

(65) Prior Publication Data

US 2022/0195822 A1 Jun. 23, 2022

(51) Int. Cl.
*E21B 23/01* (2006.01)
*E21B 33/129* (2006.01)

(52) U.S. Cl.
CPC ..... *E21B 23/01* (2013.01); *E21B 33/1292* (2013.01)

(58) Field of Classification Search
CPC ..... E21B 23/01; E21B 33/1292
See application file for complete search history.

(56) References Cited

U.S. PATENT DOCUMENTS 2,632,514 A * 3/1953 Fitzpatrick ..... E21B 33/1292 166/134
5,720,343 A 2/1998 Kilgore et al.
9,982,507 B2 5/2018 Murphree et al.
2011/0088891 A1 4/2011 Stout
2015/0034300 A1* 2/2015 Burckhard ..... E21B 23/06 166/138
2016/0265305 A1 9/2016 Davies et al.
2017/0101836 A1 4/2017 Webster et al.
2018/0216431 A1* 8/2018 Walton, III ..... E21B 23/06
2019/0316434 A1* 10/2019 Davies ..... E21B 33/1291

FOREIGN PATENT DOCUMENTS

EP 1172520 A2 1/2002
WO WO 2014/014480 A1 1/2014

OTHER PUBLICATIONS

Search Report issued for International Patent Application No. PCT/US2021/067542, dated Sep. 14, 2021, 13 pages.

* cited by examiner

*Primary Examiner* — Cathleen R Hutchins
*Assistant Examiner* — Ronald R Runyan
(74) *Attorney, Agent, or Firm* — Haynes and Boone, LLP

(57) ABSTRACT

A 3D printed barrel slip that includes a radially expandable barrel slip body that is movable from an unexpanded position to an expanded position; wherein the body has an outer surface that, when in the unexpanded position, defines a first radius; wherein the first radius is associated with a first curvature; and wherein, when in the expanded position, portion(s) of the outer surface has a second curvature that is less than the first radius. The body is an integrally formed single-component body that defines an external surface; and an internal chamber isolated from the external surface. The internal chambers affect the strength of portions of the body to control the timing of deployment of the barrel slip.

20 Claims, 15 Drawing Sheets

3D PRINTED BARREL SLIP

TECHNICAL FIELD

The present disclosure relates generally to a barrel slip, and specifically, to a barrel slip that is at least partially manufactured using additive manufacturing, such as 3D printing.

BACKGROUND

In the course of treating and preparing subterranean wells for production, a well packer is run into the well on a work string or a production tubing. The purpose of the packer is to support production tubing and other completion equipment, such as a screen adjacent to a producing formation, and to seal the annulus between the outside of the production tubing and the inside of the well casing to block movement of fluids through the annulus past the packer location. The packer is provided with a barrel slip that has opposed camming surfaces which cooperate with complementary opposed wedging surfaces, whereby the barrel slip is radially extendible into gripping engagement against the well casing bore in response to relative axial movement of the wedging surfaces. Due to the geometric shape of the barrel slip components, the barrel slip may prematurely set, teeth of the barrel slip may not provide a consistent grip on the casing, and some portions of the barrel slip may deploy before others resulting in a suboptimal grip on the casing.

Accordingly, a need has arisen for a barrel slip that is at least partially manufactured using additive manufacturing, such as 3D printing, to improve loading of the barrel slip and gripping of the casing by the barrel slip.

DETAILED DESCRIPTION

Illustrative embodiments and related methods of the present disclosure describe a barrel slip, and specifically, to a barrel slip that is at least partially manufactured using additive manufacturing, such as 3D printing. In some embodiments, the 3D printed barrel slip allows for geometric shapes and designs that are not possible from conventional manufacturing. In some embodiments, the 3D printed barrel slip results in better slip engagement.

Figure 1:
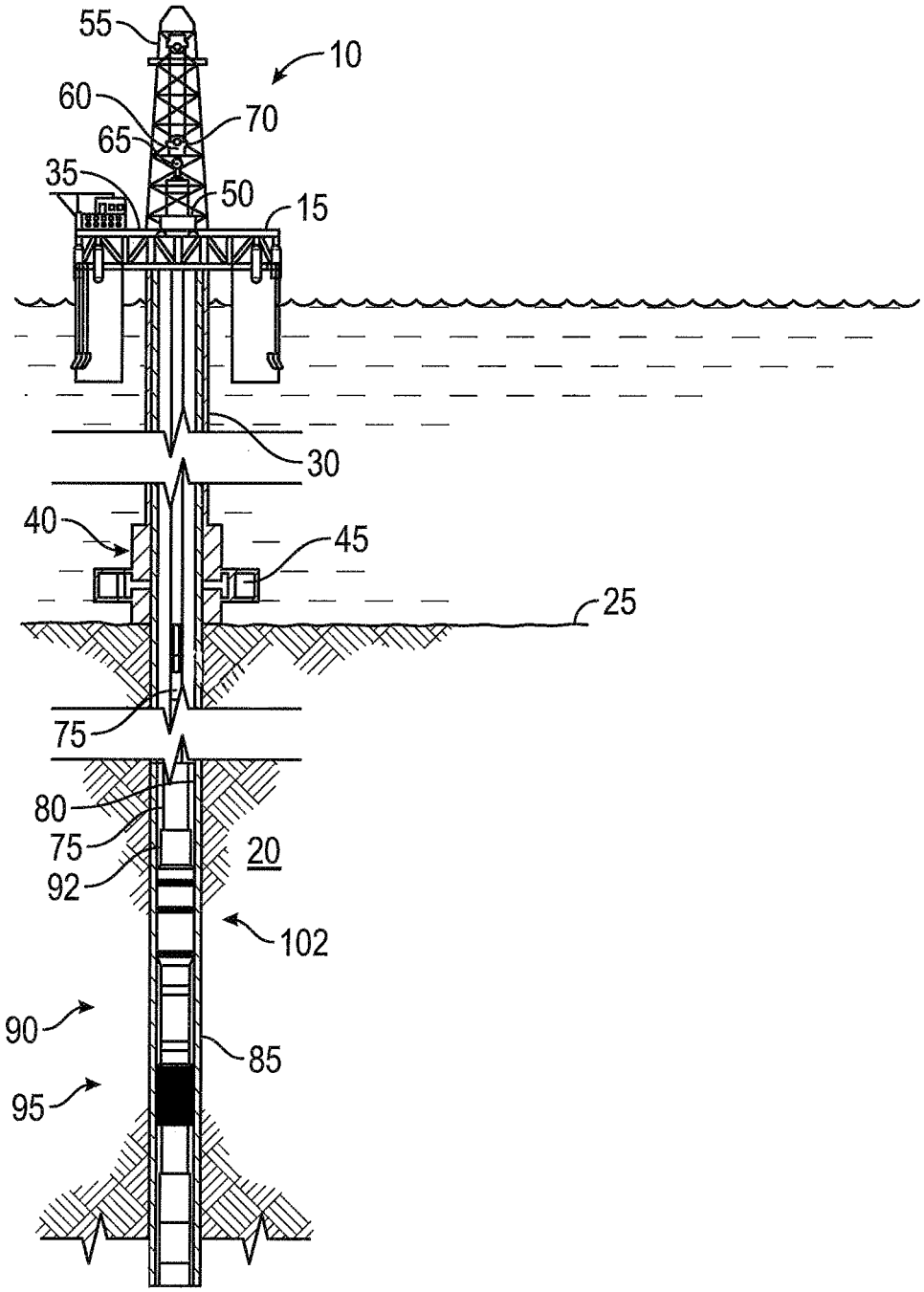
FIG. 1 is a schematic illustration of an offshore oil and gas platform operably coupled to a working string that includes a well packer, according to an example embodiment of the present disclosure.

FIG. 1 is a schematic illustration of an offshore oil and gas platform operably coupled to a working string that includes a barrel slip assembly. The offshore oil and gas platform is generally designated 10. Even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores, or the like. Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel 70 for raising and lowering pipe strings, such as a substantially tubular, axially extending running or tubing string 75.

As in the present example embodiment of FIG. 1, a borehole or wellbore 80 extends through the various earth strata including the formation 20, with a portion of the wellbore 80 having a casing string 85 cemented therein. A well packer 90 is shown in releasably set, sealed engagement against the casing string 85. A mandrel 92 of the packer 90 is connected to the tubing string 75. The packer 90 is releasably set and locked against the casing 85 by an anchor slip assembly 95 that includes a barrel slip 100 (shown in FIG. 2A). A seal element assembly 102 mounted on the mandrel 92 is expanded against the well casing 85 for providing a fluid tight seal between the mandrel 92 and the casing 85 so that formation pressure is held in the wellbore 80 below the seal assembly 102 and formation fluids are forced into a bore of the packer 90 to flow to the surface through the production tubing string 75.

Figure 2A:
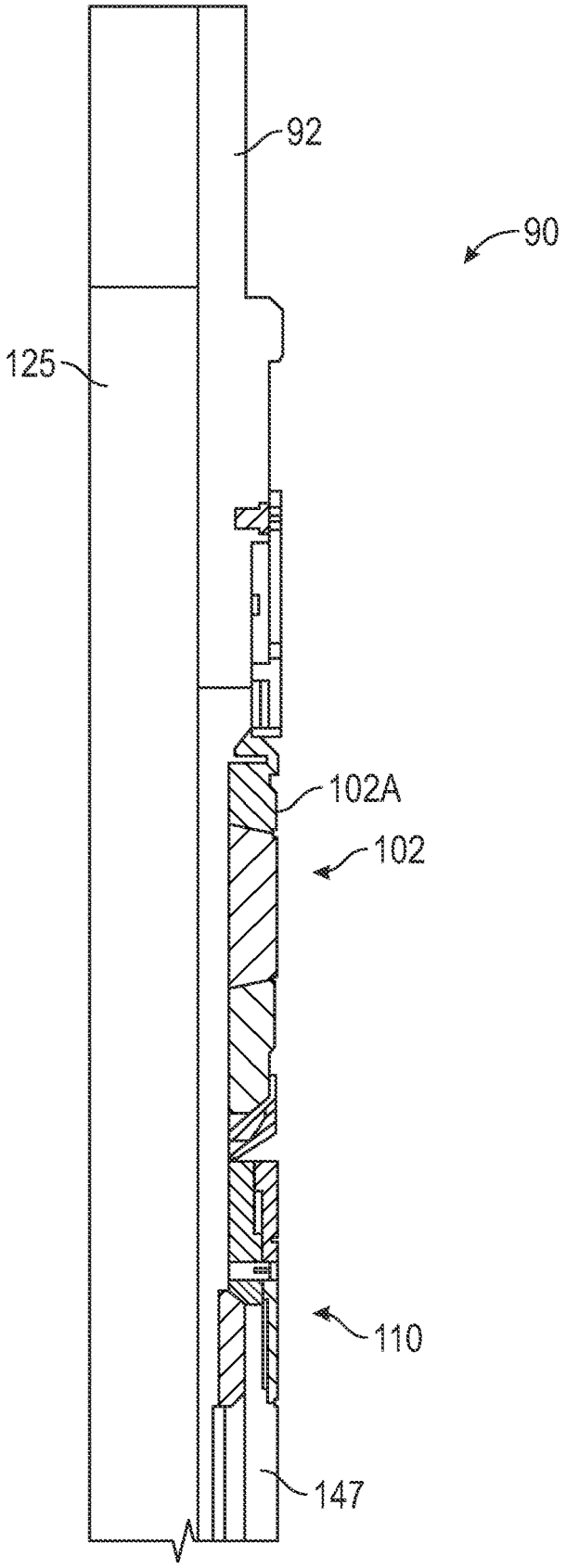
FIGS. 2A-2C together illustrate a cross-sectional view of the well packer of FIG. 1, the well packer comprising a barrel slip, according to an embodiment of the present disclosure.
Figure 2B:
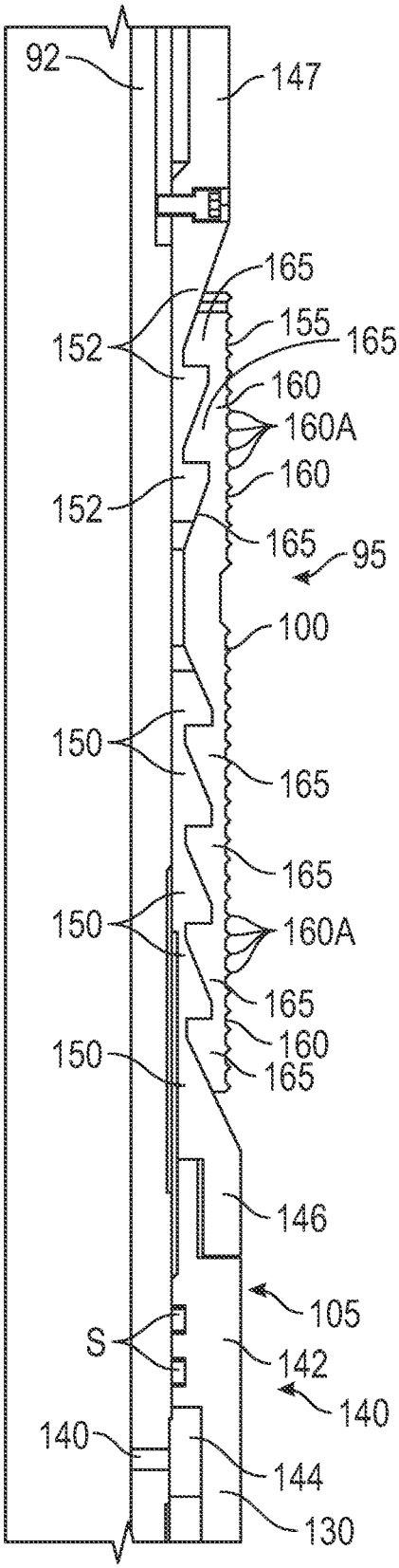
Figure 2C:
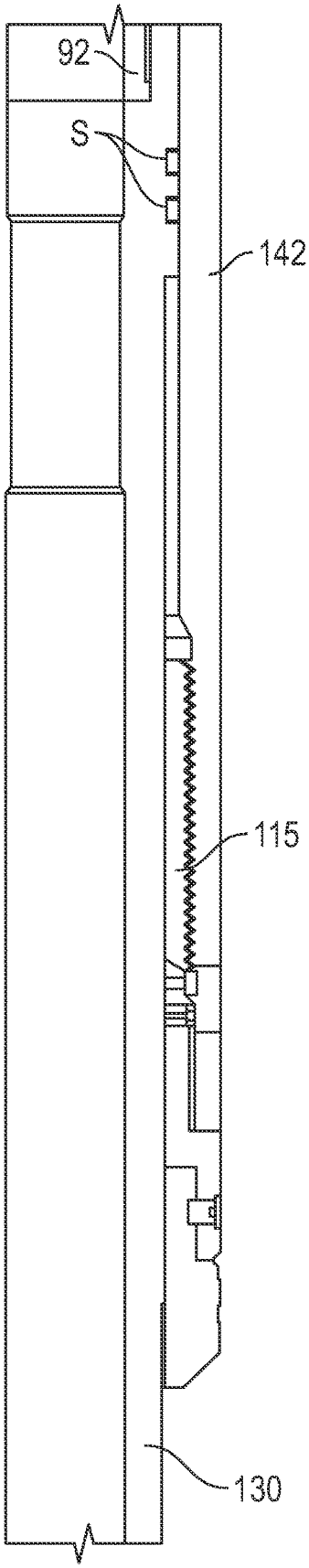

Referring now to FIGS. 2A-2C, which shows the packer as it is configured for running into the well for placement, the packer 90 is run into the wellbore 80 and set by hydraulic means. However, the packer 90 is not limited to being set by hydraulic means and the hydraulic means may be substituted or augemented with a mechanical set with drag blocks, a motor set, and/or a atmosphere set. The barrel slip 100 of the anchor slip assembly 95 is first set against the well casing 85, followed by expansion of the seal element assembly 102. The packer 90 includes force transmitting apparati 105 and 110 with a cinch slip 115 which maintains the set condition after the hydraulic setting pressure is removed. The packer 90 is readily retrieved from the well bore by cutting the mandrel 92 and by a straight upward pull which is conducted through the mandrel and thereby permits the barrel slip 100 to retract and the seal elements 120A to relax, thus freeing the packer for retrieval to the surface. The entire packer and attached tubing is retrieved together.

The anchor slip assembly 95 and the seal element assembly 102 are mounted on the tubular body mandrel 92 having a cylindrical bore 125 defining a longitudinal production flow passage. The lower end of the mandrel 92 is firmly coupled to a bottom connector sub 130. The bottom connector sub 130 is continued below the packer 90 within the well casing for connecting to a sand screen, polished nipple, tail screen and sump packer, for example. The central passage of the packer bore 135 as well as the polished bore, bottom sub bore, polished nipple, sand screen and the like are concentric with and form a continuation of the tubular bore of the upper tubing string 75.

In the preferred embodiment described herein, the packer 90 is set by a hydraulic actuator assembly 140, which comprises a piston 142 concentrically mounted on the mandrel 92, enclosing an annular chamber 144 which is open to the cylindrical bore 135 at port 140. The hydraulic actuator assembly 140 is coupled to the lower force transmitting assembly 105 for radially extending the anchor slip assembly 95 and seal element assembly 102 into set engagement against the casing 85. Referring to FIG. 2B, the hydraulic actuator includes a tubular piston 142 which carries annular seals S for sealing engagement against the external surface of the mandrel 92. The piston 142 is also slidably sealed against the external surface of a bottom connector sub 130. The piston 142 is firmly attached to a lower wedge 146. Hydraulic pressure is applied through the inlet port 140 which pressurizes the annular chamber 144. As the chamber is pressurized, the piston 142 is driven upward, which thereby also moves the lower wedge 146 upward. As illustrated, the slip assembly 95 generally includes the lower wedge 146, an upper wedge 147, and the barrel slip 100. The lower wedge 146 is positioned between the external surface of the mandrel 92 and the lower bore of the barrel slip 100 and features a number of upwardly facing frustoconical wedging surface cones 150. In the run-in position, the lower wedge 146 and its cones 150 are fully retracted and are blocked against further downward movement relative to the slip carder by the piston 142. The upper wedge 147 likewise has a number of downwardly facing frustoconical wedging surface cones 152. The barrel slip 100 is snugly fitted on the exterior surface of the upper and lower wedges 147 and 146. The interior of the barrel slip 100 comprises a series of surface cones 165 positioned adjacent to and generally complementary with the cones 150 and 152. The barrel slip 100 has a plurality of slip anchors 155 which are mounted for radial movement. In some embodiments, a large number of slips, such as twelve or fourteen, is preferable. Each of the slip anchors 155 includes gripping surfaces 160 positioned to extend radially into the casing wall. Each of the gripping surfaces has horizontally oriented gripping edges 160A or teeth, which provide gripping contact in each direction of longitudinal movement of the packer 90. The gripping surfaces, including the horizontal gripping edges, are radially curved to conform with the cylindrical internal surface of the well casing bore against which the slip anchor members are engaged in the set position. As the packer is generally required to potentially withstand more loading in the upward direction, in some embodiments the barrel slip 100 has a longer lower face to resist upward movement. In some embodiments, the barrel slip 100 has gripping edges 160A or teeth that are oriented to prevent "upward" movement at the "top" of the barrel slip 100 and gripping edges 160A or teeth that are oriented to prevent "downward" movement at the "bottom of the barrel slip 100. In those instances, the "center" of the slip is the point along the axial length of the packer at which the gripping edges change directions. As illustrated in FIGS. 2A-2C, the barrel slip 100 engages the upper wedge 147 and the lower wedge 146. However, in other embodiments the barrel slip 100 is a uni-directional slip in that it is designed to prevent movement in one direction.

Figure 3:
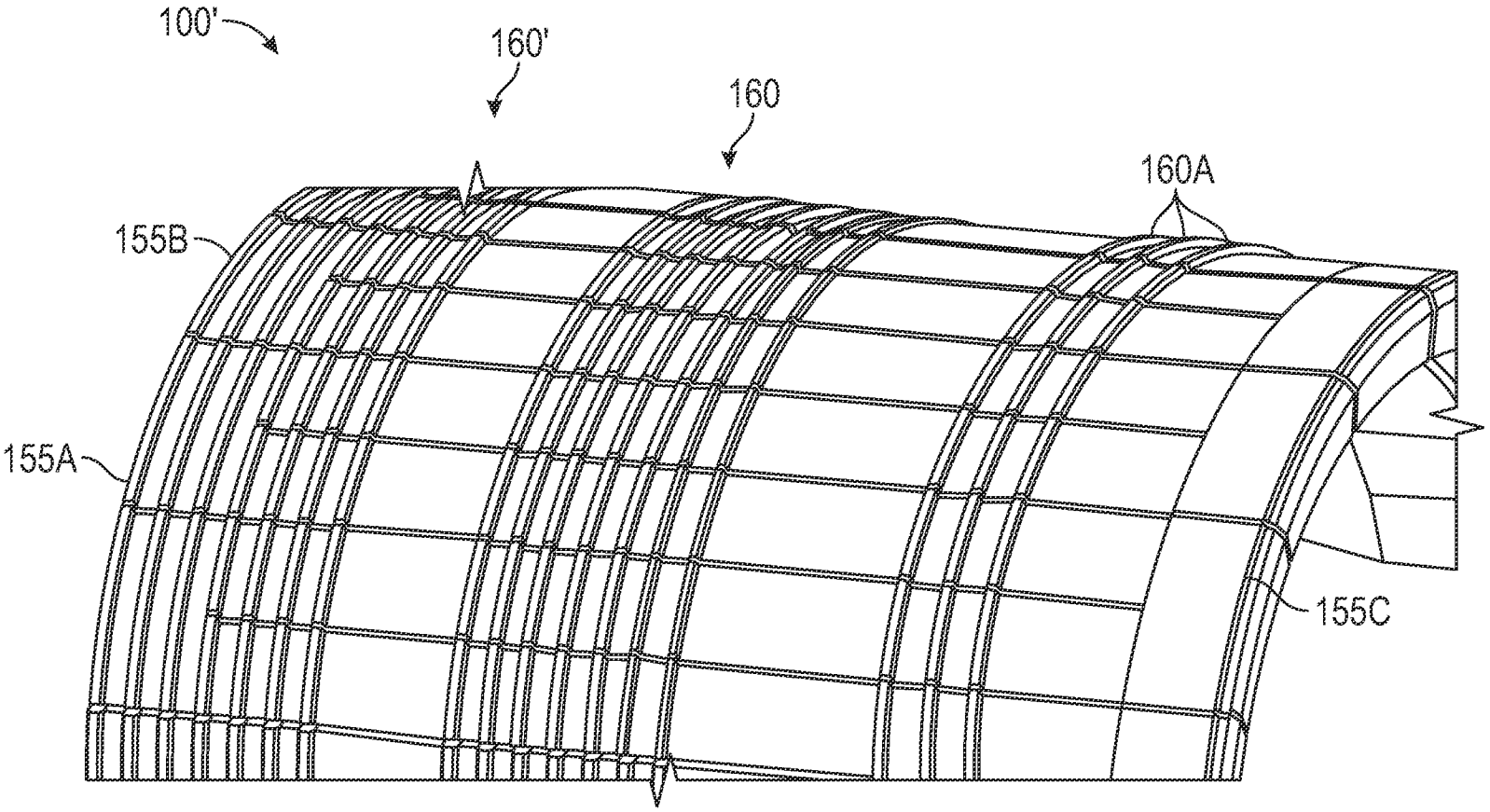
FIG. 3 illustrates a perspective view of a portion of the barrel slip of FIG. 2, according to an embodiment of the present disclosure.
Figure 4:
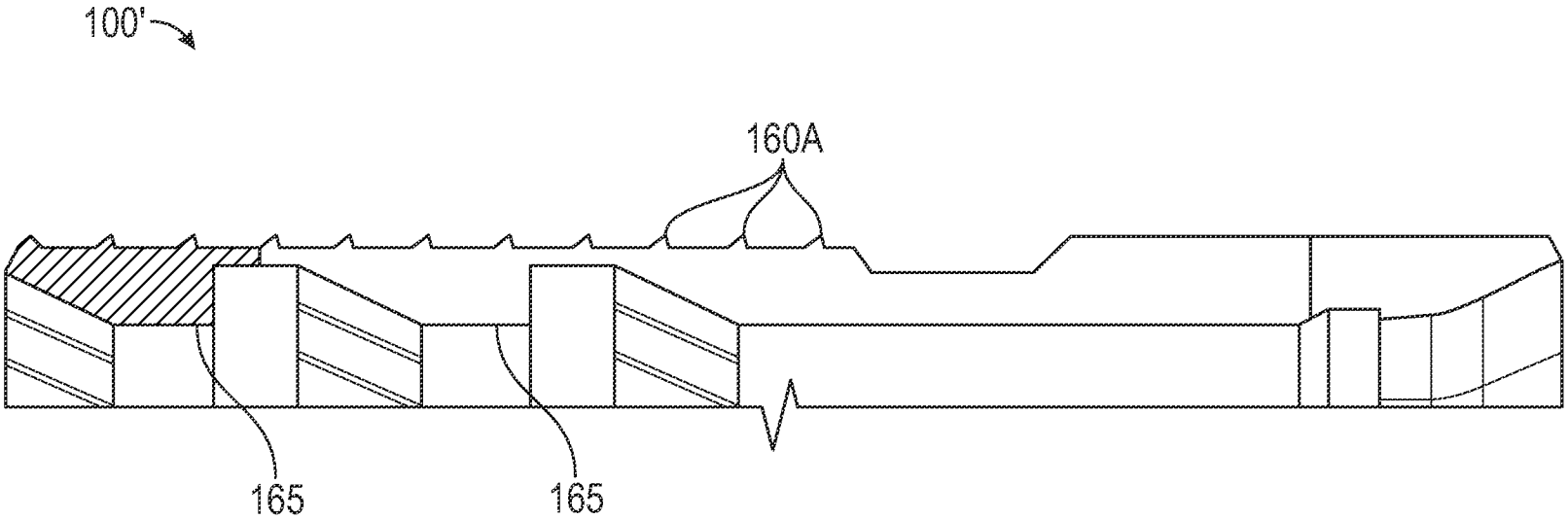
FIG. 4 illustrates a cross-sectional view of the barrel slip of FIG. 3, according to an embodiment of the present disclosure.

FIGS. 3-4 illustrate a unidirectional barrel slip 100', with FIG. 3 being a perspective view of a portion of the barrel slip 100' and FIG. 4 being a cross-sectional view of the barrel slip 100'. Slips anchors 155, such as slip anchors 155*a*, 155*b*, and 155*c* each include gripping surfaces that include gripping edges 160A or teeth. The surface cones 165 are formed such that they are positioned adjacent to and generally complementary with cones 150 or 152 when fitted around the wedge 147.

Figure 5:
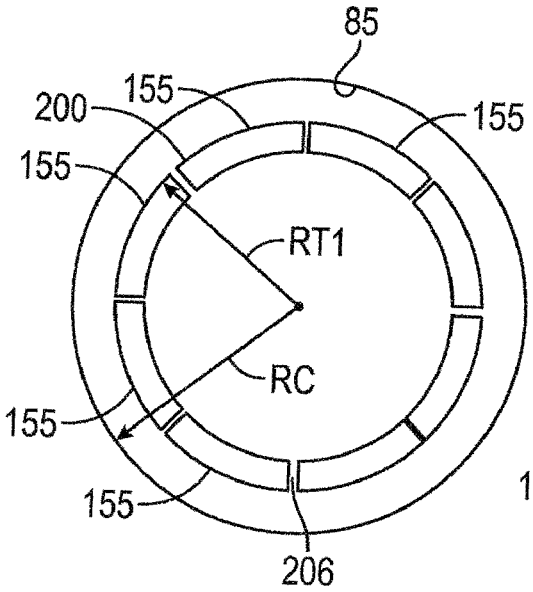
FIG. 5 (Prior Art)
FIG. 5 illustrates a cross-sectional view of a diagrammatic illustration of a traditional barrel slip within casing in an unexpanded position.
Figure 6:
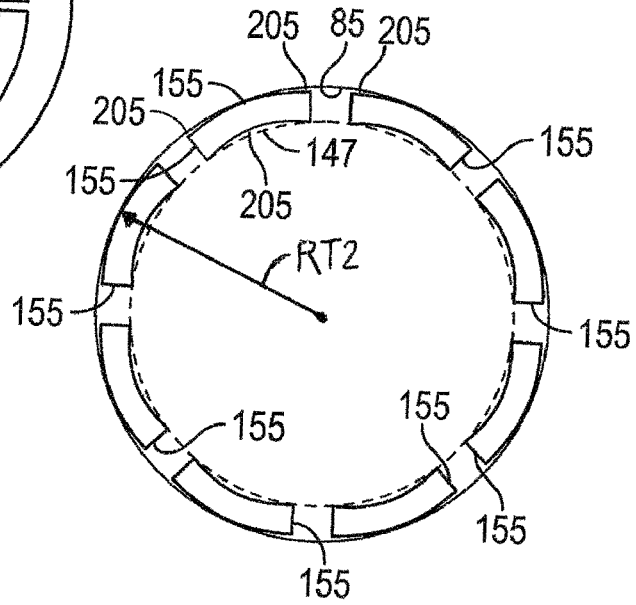
FIG. 6 (Prior Art)
FIG. 6 illustrates a cross-sectional view of a diagrammatic illustration of a traditional barrel slip and wedge within casing in an expanded position.

FIG. 5 illustrates a traditional barrel slip 200 in its run-in position relative to the casing 85. As illustrated, the slip anchors 155 of the barrel slip 200 together form a cylinder having a radius of RT1. That is, the outer surface of the slip anchors 155 form a cylinder having the radius RT1. Each of slip anchors 155 has an outer surface with a curvature that is a function of or associated with RT1. That is, the slip anchors 155 together form a circular cross-section when un-expanded. When slip 200 is expanded into larger a diameter, the outer surfaces of the expanded slip anchors 155 no longer form ideal circle, but it creates more of an octagon shape (or a polygon shape corresponding to the number of slip anchors 155). When in the expanded position and as illustrated in FIG. 6, the outer surfaces of the slip anchors 155 of the traditional barrel slip 200 are pushed against the inner surface of the casing 85 such that the slip anchors 155 form a cylinder having a radius RT2, which is generally the same as the internal radius RC defined by the inner surface of the casing 85. However, as the radius RC defined by the inner surface of the casing 85 is larger than RT1, the curvature of the inner surface of the casing 85 is greater than the curvature of the outer surface of the slip anchors 155 and gaps 205 appear between the outer surfaces of the slip anchors 155 and the inner surface of the casing 85. This results in unevenly distributed contact with the casing 85. Similarly, the inner surface of the slip anchors 155 have a curvature that is smaller than the outer surface of its corresponding wedge 147. As such, gaps 205 form between the wedge 147 and the inner surface of the slip anchors 155. Again, unevenly distributed contact is created between the wedge 147 and the slip anchors 155. Traditionally, because the curvature of the outer surface of the slip anchors 155 is a function of the radius of the slip anchor 200 when in the unexpanded state and the curvature of the inner surface of the slip anchors 155 being a function of the inner radius of the slip anchor 200, the thickness of a gap 206 formed between slip anchors 155 was consistent in the cross-sectional view when the slip is in the unexpanded position.

Figure 7:
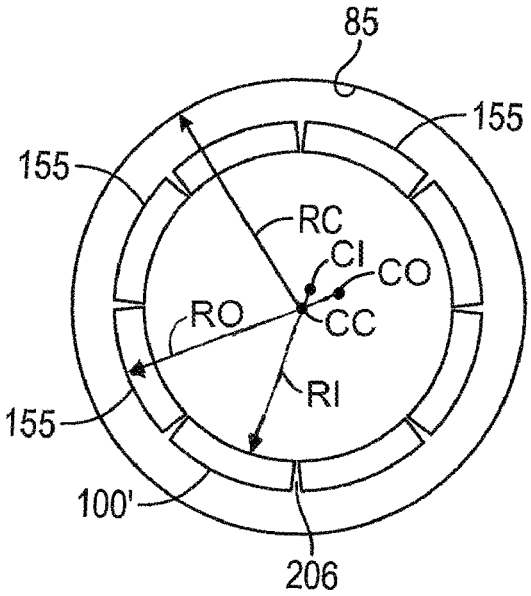
FIG. 7 illustrates a cross-sectional view of a diagrammatic illustration of the barrel slip of FIG. 3 within casing in an unexpanded position, according to an embodiment of the present disclosure.
Figure 8:
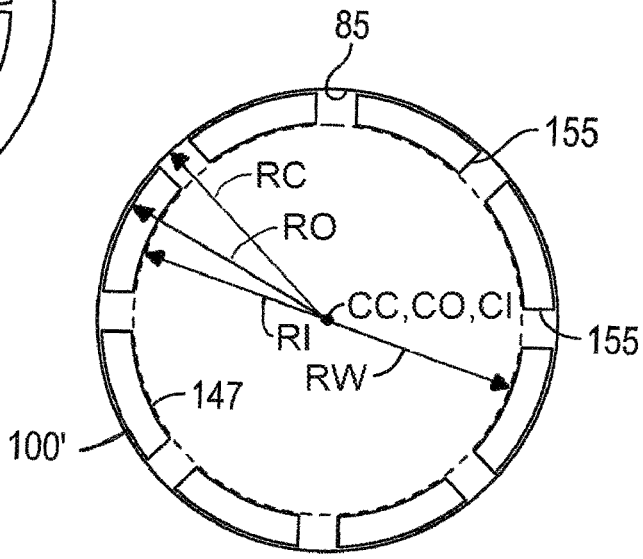
FIG. 8 illustrates a cross-sectional view of a diagrammatic illustration of the barrel slip of FIG. 7 and wedge within casing in an expanded position, according to an embodiment of the present disclosure.

FIG. 7 illustrates the barrel slip 100' in its run-in position relative to the casing 85. As illustrated, the slip anchors 155 each have an outer surface having the curvature RO, or about RC, and each have an inner surface having a curvature RI associated with the curvature RW of the external surface of the wedge 147 when the wedge 147 is in the expanded position. When the barrel slip 100' is in the unexpanded position, a center CO of the curvature RO for each slip anchor 155 is offset from a center CC of the casing 85. Similarly, a center CI of the curvature RI for each slip anchor 155 is also offset from the center CC of the casing 85. When in the expanded position and as illustrated in FIG. 8, the centers of the curvatures RO and RI converge with the center CC of the casing 85, the outer surfaces of the slip anchors 155 are pushed against the inner surface of the casing 85 and no gaps, fewer (relative to the slip 200) gaps, or smaller (relative to the slip 200) gaps form between the casing 85 and the external surface of the slip anchors 155. This improves distribution of contact on the casing 85. Similarly, because the inner surface of the slip anchors 155 have a curvature RI that corresponds with the curvature RW of the outer surface of its corresponding wedge 147 when the wedge 147 is in the expanded position, no gaps, fewer gaps, or smaller gaps form between the wedge 147 and the inner surface of the slip anchors 155. Again, this improves distribution of contact between the wedge 147 and the slip anchors 155. In some embodiments, because the curvature RO of the outer surface of the slip anchors 155 is a function of the radius RC and the curvature RI of the inner surface of the slip anchors 155 is a function of the radius RW of the wedge 147 when the wedge 147 is in the expanded state, the thickness of the gap 206 formed between slip anchors 155 when the slip 100' is in the unexpanded position increases as it extends from the inner surface of the slip anchors 155 towards the external surface of the slip anchors 155.

Figure 9:
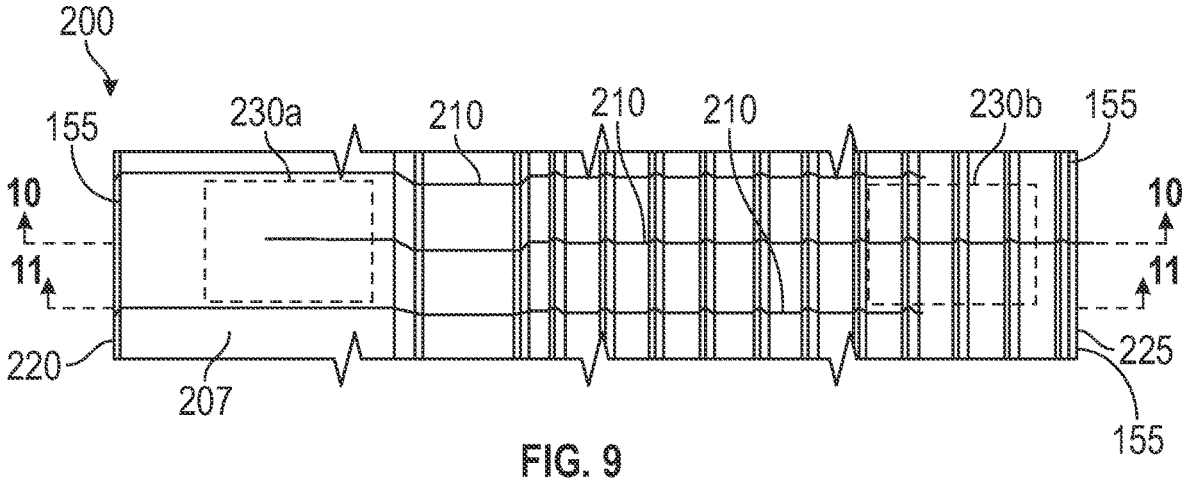
FIG. 9 (Prior Art)
FIG. 9 illustrates a front view of a portion of a traditional barrel slip.
Figure 10:
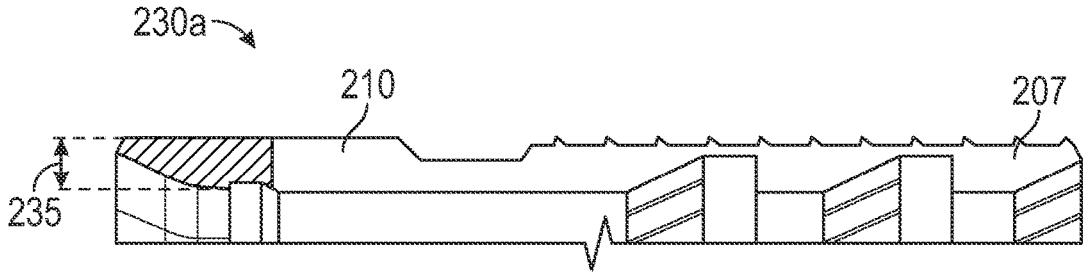
FIG. 10 (Prior Art)
FIG. 10 illustrates a cross-sectional view, along the lines 10-10, of the portion of the traditional barrel slip of FIG. 9.
Figure 11:
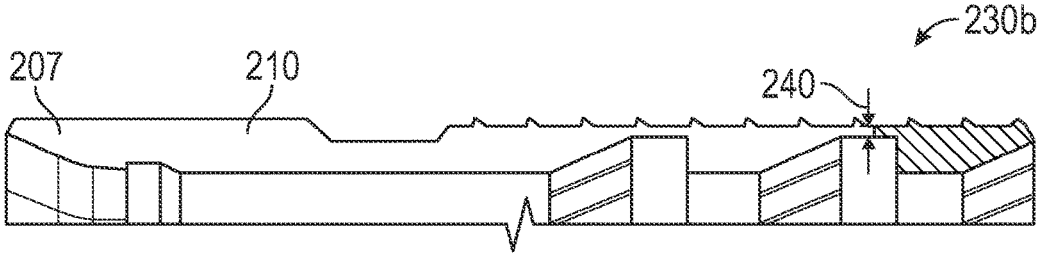
FIG. 11 (Prior Art)
FIG. 11 illustrates a cross-sectional view, along the lines 11-11, of the portion of the traditional barrel slip of FIG. 9.

FIGS. 9-11 illustrates a portion of the traditional uni-directional barrel slip 200, with FIG. 9 being a front view of a portion of the barrel slip 200 and FIGS. 10 and 11 being cross-sectional views of the uni-directional barrel slip 200. As illustrated, one slip anchor 155 is distinguished from another slip anchor 155 via gaps 210 formed in a 207 body of the barrel slip 200. Each gap extends from one of the ends 220, 225 of the slip 200 and inwardly towards a saddle portion 230 such as saddle portions 230*a* and 230*b*. With the traditional barrel slip 200, the gaps 210 are cuts created in the body 207 by a water jet, EDM, or other suitable method. Generally, the gaps 210 create a slip beam pattern by defining the size and shape of the anchor slips 155. Generally, the radial expansion of each slip anchor 155 at the ends 220, 225 depends on the stiffness associated with the saddle portions 230*a*, 230*b*, respectively. It is difficult or impossible to obtain similar stiffness on the opposing saddle portions 230*a*, 230*b* due to geometry of the body 207 and the gaps 210. As illustrated in FIG. 10, a thickness of the body 207 that forms the saddle portion 230*a* has a first dimension 235 whereas, as illustrated in FIG. 11, the thickness of the body 207 forming the saddle portion 230*b* has a dimension 240 that is less than the dimension 235. As illustrated in the comparison of the FIGS. 10 and 11, the geometry of the portion of the body 207 that forms the saddle portions 230*a* is different from the geometry of the portion of the body that forms the saddle portion 230*b*. Considering the body 207 is a formed from a solid material, the geometry of these portions affects the necessary force required to expand these opposing ends 220, 225 of the barrel slip 200. For example, the end 220 with the saddle portion 230*a* may require more force than the end 225 with the saddle portion 230*b*. This often causes one end to deploy properly, but another end does not or yields prior to achieve the same deployment. As illustrated in FIGS. 10 and 11, the gaps 210 are generally cuts through the entire thickness of the body 207, which is solid, and thus extend from an interior surface of the slip 200 to an exterior surface of the slip 200.

Figure 12:
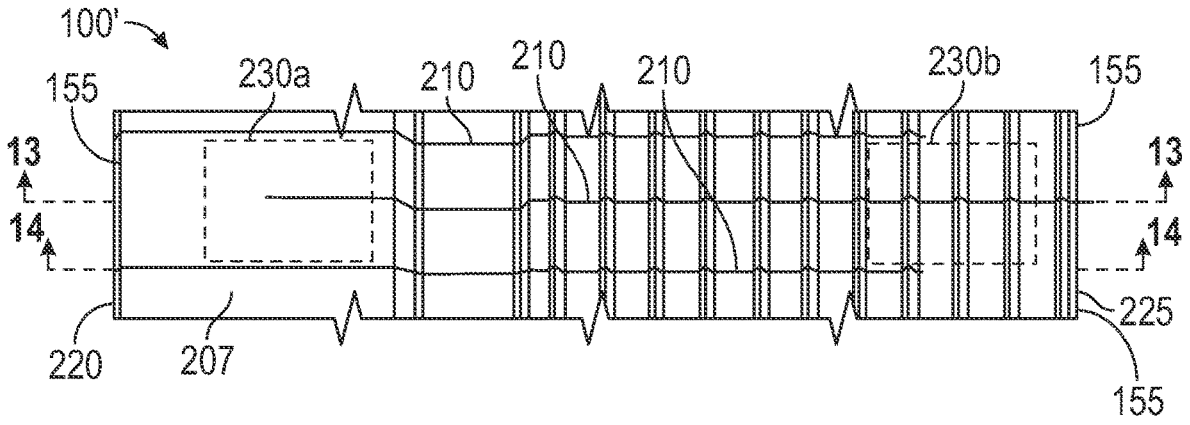
FIG. 12 illustrates a front view of a portion of the barrel slip of FIG. 3, according to an embodiment of the present disclosure.
Figure 13:
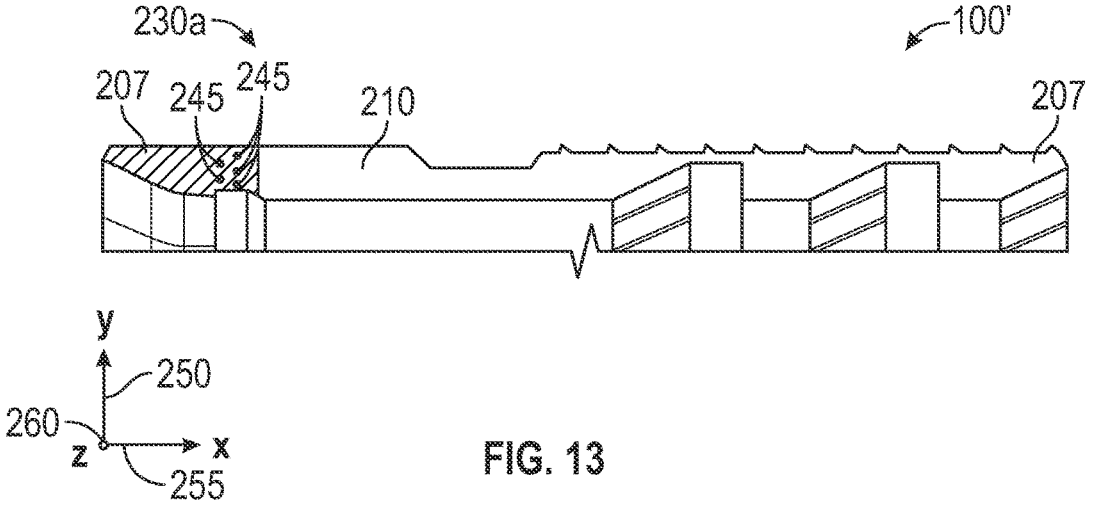
FIG. 13 illustrates a cross-sectional view, along the lines 13-13, of the portion of the barrel slip of FIG. 3, according to an embodiment of the present disclosure.
Figure 14:
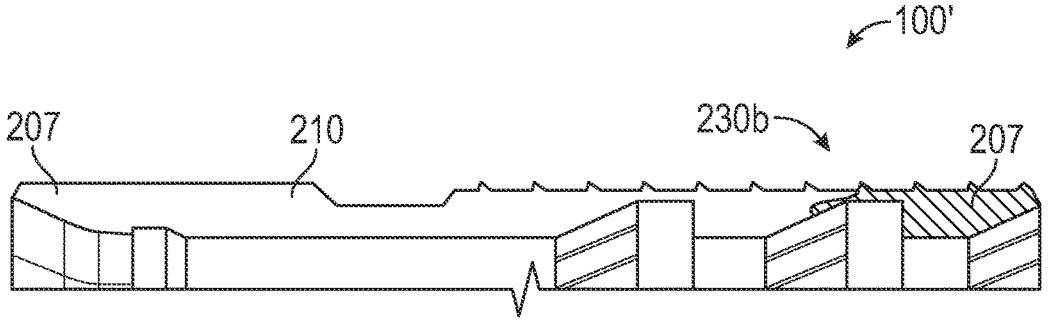
FIG. 14 illustrates a cross-sectional view, along the lines 11-11, of the portion of the barrel slip of FIG. 3, according to an embodiment of the present disclosure.

FIGS. 12-14 illustrate a portion of the barrel slip 100', with FIG. 12 being a front view of a portion of the barrel slip 100' and FIGS. 13-14 being cross-sectional views of the uni-directional barrel slip 100'. Reference numerals used for the components of the barrel slip 200 are used for components of the barrel slip 100' that are similar or identical to the components of the barrel slip 200. As illustrated, the body 207 is printed such that gaps 210 are voids formed between anchor slips 155. As such, the gaps 210 are not formed via water jet or via other traditional methods as noted above and the geometry of the gaps 210 is not limited to traditional shapes. Moreover, the stiffness of each saddle portion 230*a* and 230*b* can be designed such that the difference in stiffness between the saddle portions 230*a* and 230*b* is reduced or eliminated. For example, a saddle portion that is traditionally stronger than another saddle portion may be "weakened" by reducing the cross-sectional area in that zone, such as from a plurality of internal chambers 245. As illustrated in FIG. 13, the barrel slip 100' includes one or a plurality of internal chambers 245 within the body 207. In one or more example embodiments, an internal chamber is an internal chamber that is spaced from an exposed surface or is a chamber that does not penetrate the exposed surface, with examples of an exposed surface being the external surface of the slip 100', the internal surface of the slip 100', surfaces that define the end portions 220, 225, and surfaces of the body 207 that define the gaps 210. In one or more example embodiments, the plurality of internal chambers 245 are spaced along the thickness of the body 207 measured in the direction 250, the width of the body 207 measured in the direction 255, and the depth of the body 207 measured in the direction 260. In one or more example embodiments, the spacing of the plurality of internal chambers 245 along the thickness, width, and depth of the body 207 forms an internal chamber array. In one or more example embodiments, the plurality of internal chambers 245 may be a variety of shapes, such as a spherical, a cone, a pyramid, a cube, a cylinder, etc. The internal chambers may be isolated from the exterior surface, as shown in the figure, or there may be a fluid connection to the one of the surfaces of the barrel slip. The plurality of internal chambers may have a smaller passageway connecting the plurality of larger chambers to that the plurality of internal chambers may be in fluid communication with each other. In one or more example embodiments, the plurality of internal chambers 245 may be spaced in a variety of arrays to form a porous body 207. Thus, a portion of the body 207 is "hollowed" using internal chambers 245, such as spherical internal chambers, with same or different sizes, or internal chambers of other shapes, such as honeycomb. In one or more example embodiments, the density of the internal chambers 245 may be uniform or gradient. In one or more example embodiments, each of the internal chambers in the plurality of internal chambers 245 is of engineered size distribution and internal chamber density distribution. In one or more example embodiments, the plurality of internal chambers is pre-determined by numerical analysis to cause the end portions of the slip 100' to deploy simultaneously or in a predetermined, intentional order. As such, the placement of the internal chambers 245 is to change the mechanical strength performance of the saddle portions 230*a* and 230*b*. In some embodiments, the internal chambers 245 are "filled" with a material, which may be a gas or a solid, that is different from the material forming the body 207. Generally, the body 207 is an integrally formed, single-component body created via additive manufacturing to include the plurality of internal chambers 245.

In some embodiments and as illustrated in FIG. 14, the portions of the body 207 that define the gaps 210 have curved surfaces and are not limited to straight or angled surfaces that extend from the interior surface of the body 207 to the external surface of the body 207. In some embodiments, the gaps 210 or a portion of the gaps 210 do not extend through the entire thickness of the body 207. As such and in some embodiments, the gaps 210 in the slip 100' do not extend from the interior surface of the slip 100' to the exterior surface of the slip 100'. Instead, the gaps 210, or portions thereof, may extend from the external surface and towards the internal surface without extending to the internal surface to create an external channel and/or the gaps 210 or portion thereof may extend from the internal surface and towards the external surface without extending to the external surface to create an internal channel. Generally, the gaps 210 can be any shape and be placed anywhere along the body 207 such that the stiffness of each saddle portion 230*a* and 230*b* can be designed such that the difference in stiffness of the saddle portions 230*a* and 230*b* is identical or similar.

Figure 15:
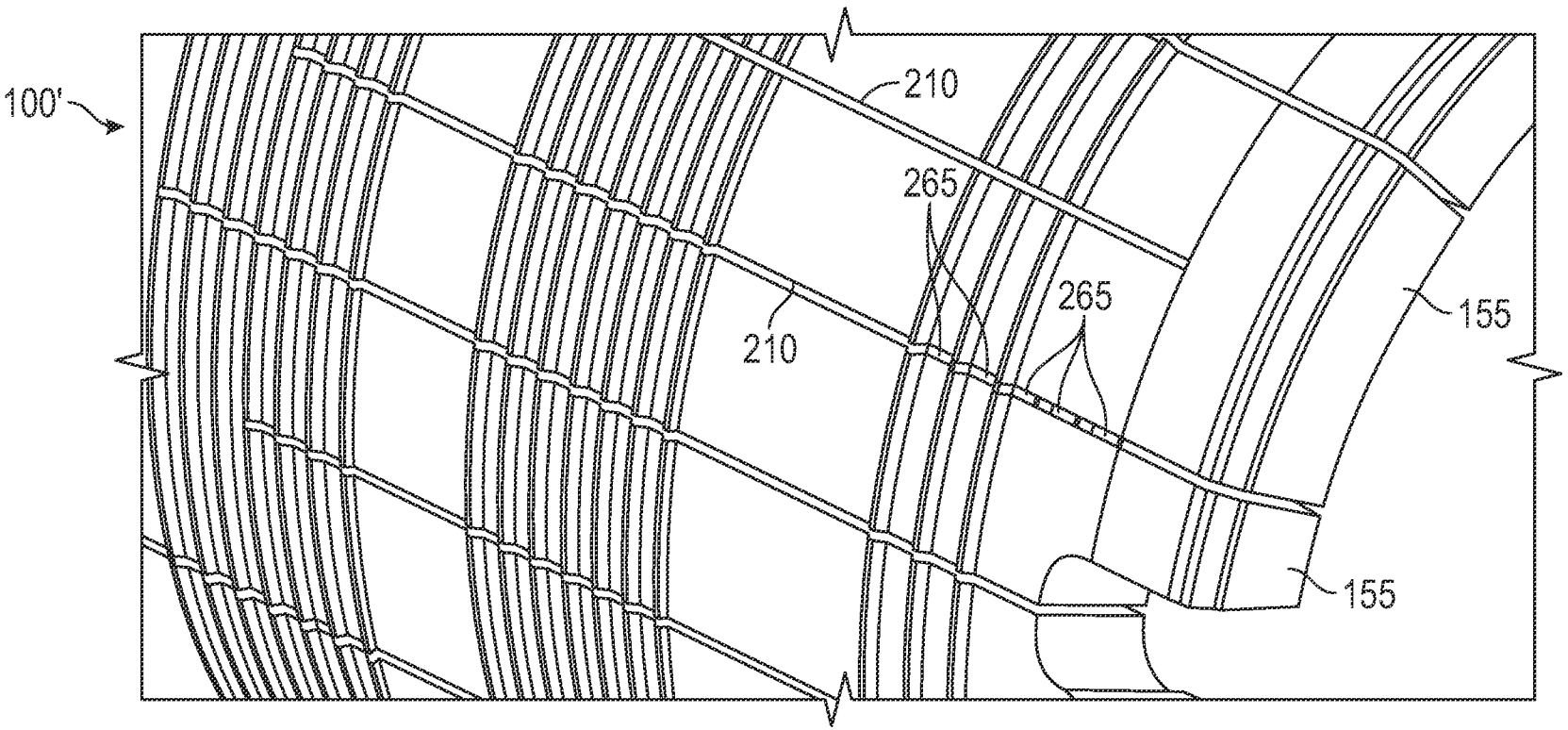
FIG. 15 illustrates a perspective view of a portion of the barrel slip of FIG. 3, according to an embodiment of the present disclosure.

In some embodiments, the gaps 210 are created when the slip 100' transitions from the unexpanded position to the expanded position. That is, portions of the body 207 are intended to fracture, break, or sever in the transition from an unexpanded to the expanded state when subjected to a predetermined fracture force. FIG. 15 illustrates a perspective view of the slip 100' when the slip 100' includes frangible connections 265. In some embodiments, a frangible connection 265 is a portion of the body 207 that is intended to fracture when subjected to the predetermined fracture force. Generally, a frangible connection 265 is positioned within a gap 210 to prevents premature setting of the barrel slip 100'. In some embodiments, the strength of each frangible connection 265 is consistent along the length, circumference, or radial direction of the barrel slip 100'. However, in other embodiments, frangible connections 265 with varying strength are positioned along length, circumference, or radial direction of the barrel slip 100'. For example, the strengths of the frangible connections 265 may be designed such that the frangible connections 265 allow for: one end of the slip 100' to expand first; the ends of the slip 100' to expand generally simultaneously; or for one portion of the circumference of the barrel slip 100' to expand first (for example setting the barrel slip 100' in a horizontal wellbore). In some embodiments, allowing one end to expand before the other results in an improved load distribution along the length of the slip 100'.

Figure 16:
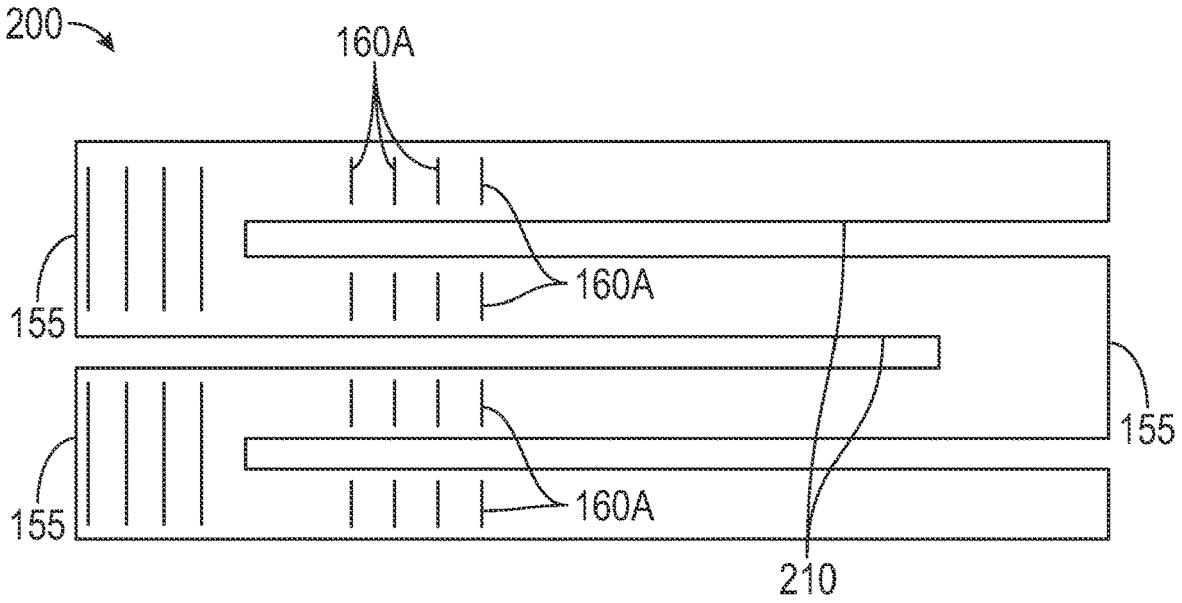
FIG. 16 (Prior Art)
FIG. 16 illustrates a front view of a diagrammatic illustration of a traditional barrel slip in an unexpanded position.
Figure 17:
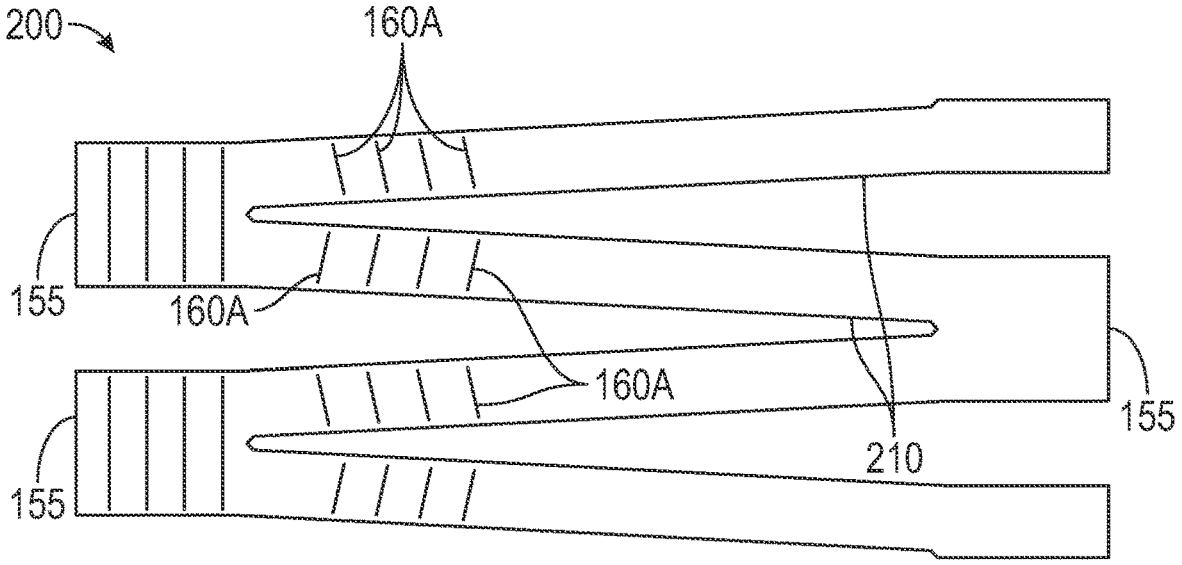
FIG. 17 (Prior Art)
FIG. 17 illustrates a front view of a diagrammatic illustration of the traditional barrel slip of FIG. 17 in an expanded position.

FIG. 16 is a diagrammatical, front view of a portion of the traditional barrel slip 200 when in an unexpanded position. As illustrated, slip teeth 160A are formed on the external surface and extend circumferentially around the external surface. As illustrated, rows of slip teeth are spaced in parallel along the length of the slip 200. As illustrated, teeth 160A spaced along one anchor slip 155 are colinear with teeth spaced along another anchor slip 155. As illustrated, the gaps 210 generally have a uniform dimension along the length of the slip 200 and a rectangular appearance. As such, the anchor slips 155 are generally also spaced in parallel. FIG. 17 is a diagrammatical, front view of the barrel slip 200 of FIG. 16 when in an expanded position. When expanded, the anchor slips 155 move such that gaps 210 expand and have a "V" shaped or "U" shaped appearance. This results in the anchor slips 155 losing their generally parallel spacing and reducing anchoring performance. Instead, the anchor slips 155 are positioned at an angle relative to one another to form a zig-zag, slanted, or any predetermined pattern. As such, at least a portion of the slip teeth 160A that were previously colinear with teeth 160A in adjacent anchor slips 155, are positioned at an angle relative to one another. This affects the interaction between the casing 85 and the teeth 160A and later load bearing performance.

Figure 18:
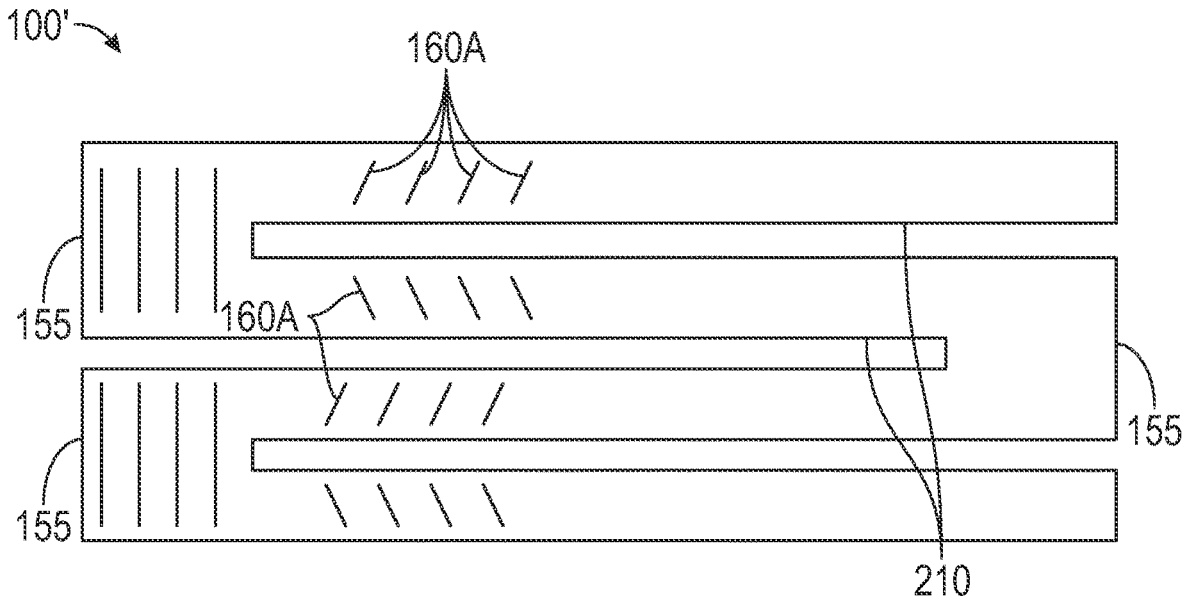
FIG. 18 illustrates a front view of a diagrammatic illustration of a portion of the barrel slip of FIG. 3 in an unexpanded position, according to an embodiment of the present disclosure.
Figure 19:
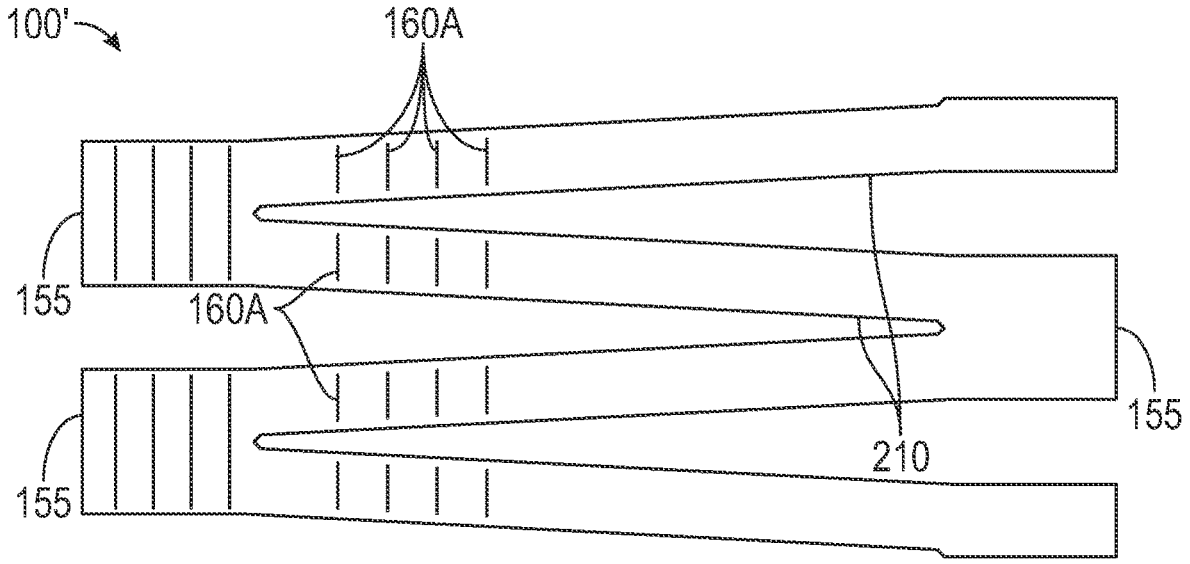
FIG. 19 illustrates a front view of a diagrammatic illustration of a portion of the barrel slip of FIG. 18 in an expanded position, according to an embodiment of the present disclosure.

FIG. 18 is a diagrammatical, front view of an example embodiment of a portion of the barrel slip 100' when in an unexpanded position. As illustrated, slip teeth 160A are formed on the external surface in a pattern such that the teeth 160A are parallel in the expanded position (as illustrated in FIG. 19). As illustrated, rows of slip teeth 160A are spaced along the length of the slip 100' at an angle relative to rows of slip teeth 160A in adjacent anchor slips 155. As illustrated, the teeth 160A spaced along one anchor slip 155 are at angle with, or rotated relative to, teeth 160A spaced along another anchor slip 155 when in the unexpanded position. As illustrated, the gaps 210 have a uniform dimension along the length of the slip 100' and a rectangular appearance when in the unexpanded position. As such, the anchor slips 155 are generally also spaced in parallel. FIG. 19 is a diagrammatical, front view of the barrel slip 100' of FIG. 18 when in an expanded position. When expanded and in some embodiments, the anchor slips 155 move such that gaps 210 expand and have a "V" shaped or "U" shaped appearance. This results in the anchor slips 155 losing the generally parallel spacing. Instead, the anchor slips 155 are positioned at an angle relative to one another to form a zig-zag pattern. When in this position, the teeth 160A spaced along one anchor slip 155 are colinear or about colinear with teeth 160A spaced along another anchor slip 155. As such, the angle formed between the teeth 160A when in the unexpanded position is reduced or eliminated when the slip 100' is in the expanded position. This improves the interaction between the casing 85 and the teeth 160A and later loading bearing performance.

Figure 20:
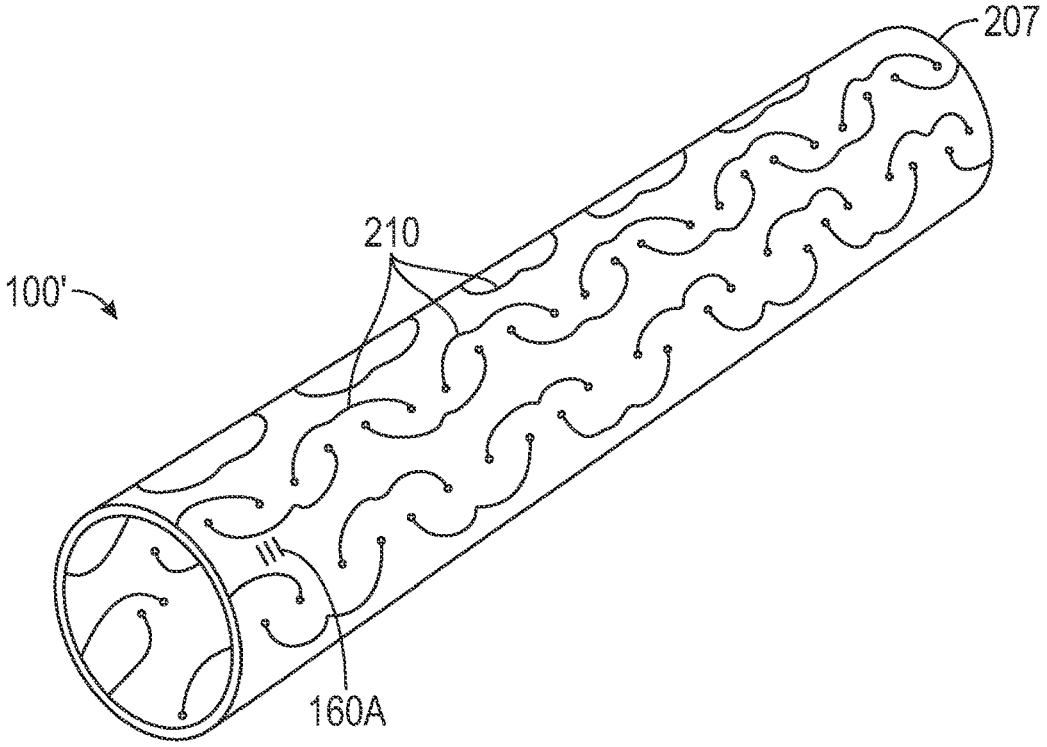
FIG. 20 illustrates a perspective view of a diagrammatic illustration of the barrel slip of FIG. 3 in an unexpanded position, according to an embodiment of the present disclosure.
Figure 21:
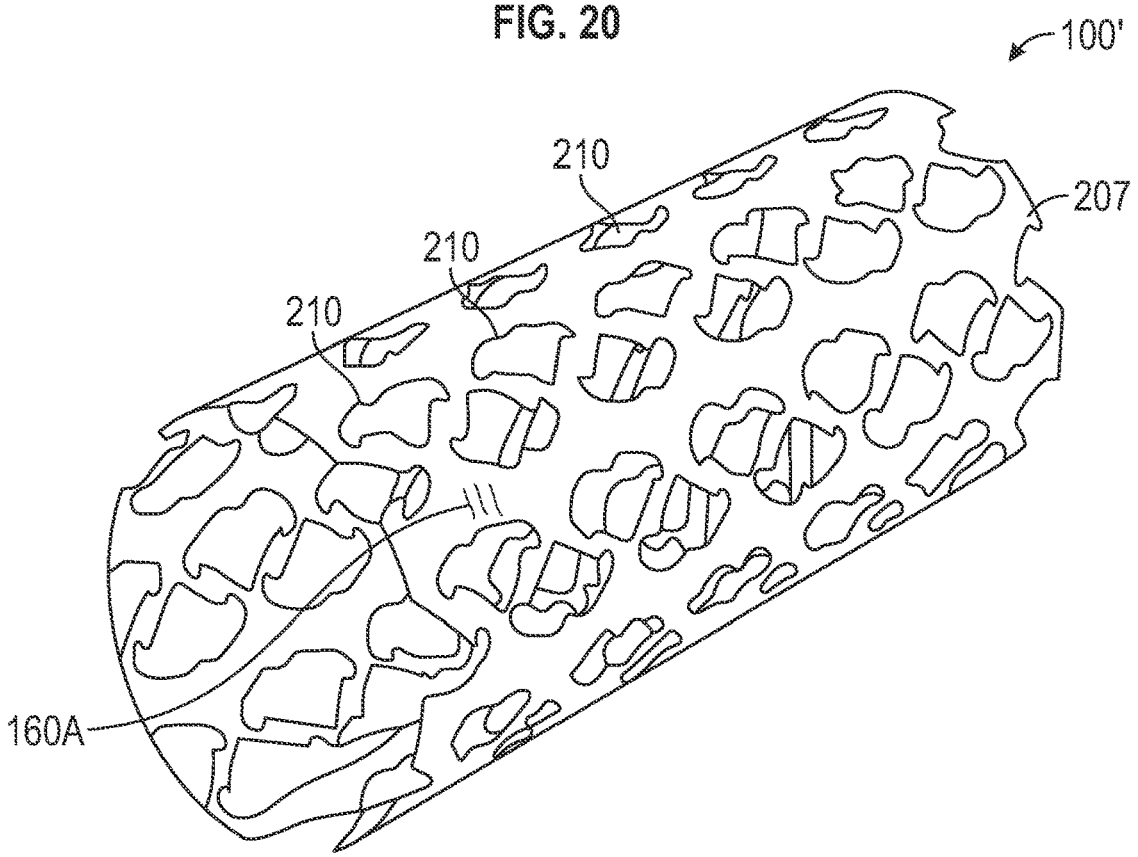
FIG. 21 illustrates a perspective view of a diagrammatic illustration of the barrel slip of FIG. 20 in an expanded position, according to an embodiment of the present disclosure.

In one embodiments, the barrel slip 100' can be cut with an internal truss structure such that the gaps 210 are formed or enlarged when transitioning from the unexpanded to expanded position. In this embodiment, there are gaps 210 that do not extend to one end of the barrel slip 100'. For example, FIGS. 20 and 21 illustrate an example body 207 of the slip 100' that has gaps 210 designed to allow for radial expansion of the slip 100' while maintaining the positioning of the teeth 160A. For example, when the teeth 160A are positioned generally perpendicular to one or both ends of the slip 100' in the unexpanded position (illustrated in FIG. 20), then the teeth remain positioned generally perpendicular to one or both ends of the slip 100' when in the expanded position (illustrated in FIG. 21). However, in some embodiments, the expansion of the body 207 cut with an internal truss structure can also include teeth 160A that are moved into a generally perpendicular position relative to one or both ends of the slip 100' upon expansion.

Figure 22:
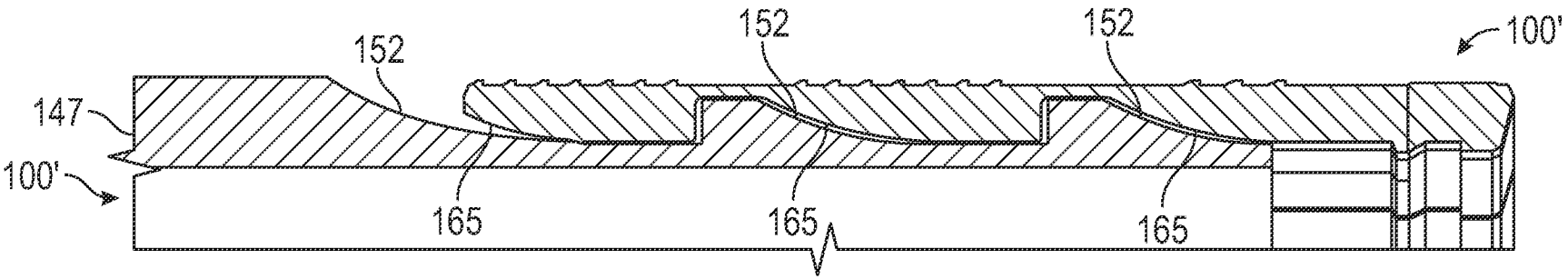
FIG. 22 illustrates a cross-sectional view of a portion of a portion of the barrel slip of FIG. 3 and a portion of a wedge, according to an embodiment of the present disclosure.

As illustrated in FIG. 22, in some embodiments the cones 165 of the barrel slip 100' can be shaped such that deployment is non-linear or progressive. That is, whereas traditional slips and wedges have cones with corresponding, uniform angles, the slip 100' and wedge 147 have loading surfaces with curvatures and/or variable curvatures such that causes variable radial expansion with constant longitudinal movement between the wedge 147 and the slip 100'. For example, when the cones 165 are angled or curved along their lengths, the deployment and load capacities can be improved. In one example, a shallow initial load is beneficial for deployment, followed by a higher angle to prevent casing deformation/wedge collapse at high load.

Figure 23:
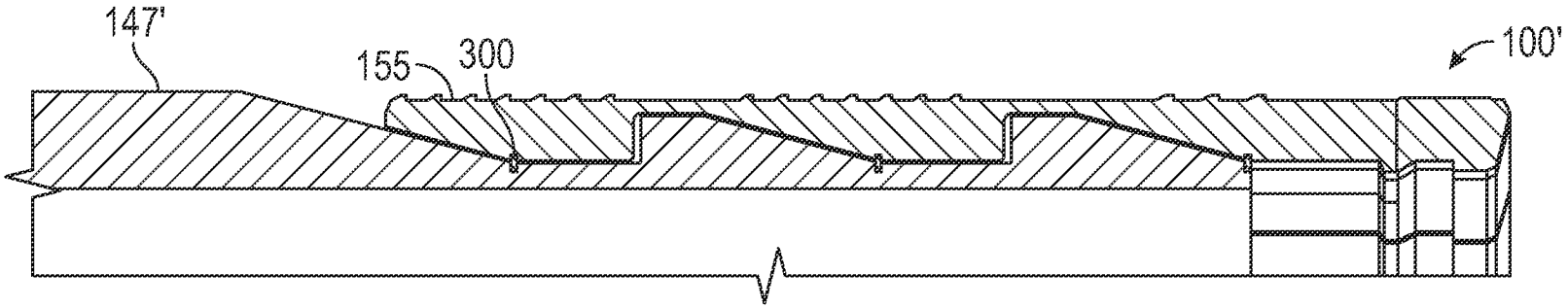
FIG. 23 illustrates a cross-sectional view of a portion of a portion of the barrel slip of FIG. 3 when integrally formed with a portion of a wedge, according to an embodiment of the present disclosure.

In some embodiments and as illustrated in FIG. 23, the barrel slip 100' includes a wedge portion 147' that is identical to or similar to the wedge 147, with the wedge portion 147' of the barrel slip 100' being connected to the wedge slip anchors 155 via one or more fracture tabs 300, which prevent premature setting of the slip 100'. That is, the wedge 147' and the slip anchors 155 are integrally formed. The barrel slip 100' is one cylindrical portion that is disposed about the wedge portion 147", which is another cylindrical portion of the barrel slip 100'. Generally, with traditional barrel slips, the wedge and the slip are machined separately, and the slip is stretched to slide over the wedges. With traditional barrel slips, this wedge diameter is the largest dimension that the barrel slips must expand during service. As such, the material of traditional barrel slips must have sufficient elastic strain to be able slide over the wedges without yielding and then elastically recoil back down. This type of material for traditional barrel slips is generally expensive, has corrosion challenges, and/or lacks toughness. By printing the barrel slip 100' to include the wedge portion 147', the slopes of the wedge may be increased, yielding potential is eliminated, and the barrel slip 100' may be composed of a wider variety of materials may be considered.

While FIGS. 3-4, 7-8, 12-15, and 18-13 depict a unidirectional barrel slip, a bidirectional barrel slip may also be considered.

Generally, the method of deploying the barrel slip 100' is similar to deploying a traditional barrel slip except that in some embodiments, the fracture tabs 300 that connect the slip anchors 155 to the wedge portion 147' are fractured, broken, or severed before the wedge portion 147' is able to move relative to the slip anchors 155. Similarly, in some embodiments the method of deploying the barrel slip 100' includes fracturing, broking, or severing the frangible connections 265 of the barrel slip 100' when transitioning the barrel slip 100' from the unexpanded to expanded position. Deploying the barrel slip 100' includes positioning the barrel slip 100' relative to the casing 85 and then expanding the slip 100' from the unexpanded to the expanded position. The expansion of the slip 100' causes anchor slips 155 to move relative to others, thereby changing the position of the anchor slips 155 relative to each other. Moreover, expansion of the slip 100' is caused by longitudinal movement of the wedge 147 or the wedge portion 147' relative to the anchor slips 155.

In some embodiments, the barrel slip 100 and/or the barrel slip 100' improves the area of engagement between the teeth 160A and the interior surface of the casing 85 and improves the area of engagement between the exterior surfaces of the wedge 147 and the interior surfaces of the anchor slips 155. In some embodiments, the barrel slip 100 and/or the barrel slip 100' optimized deployment by equalizing deployment of non-symmetric slips. In some embodiments, the barrel slip 100 and/or the barrel slip 100' eliminates the need to expand the anchor slips 155 over the cones 152 of the wedge 147, which reduces the installation stress and potential yielding. As such, the barrel slip 100 and/or the barrel slip 100' may be composed of a wider variety of materials than traditional slips. In some embodiments, the barrel slip 100 and/or the barrel slip 100' improves the biting engagement between the teeth 160A and the interior surface of the casing 85. In some embodiments, the barrel slip 100 and/or the barrel slip 100' reduces the instances or likelihood of premature setting of the anchor slips 155. In some embodiments, the barrel slip 100 and/or the barrel slip 100' improves the deployment process via variable radial expansion based on constant longitudinal movement of the anchor slips 155.

In several example embodiments, while different steps, processes, and procedures are described as appearing as distinct acts, one or more of the steps, one or more of the processes, and/or one or more of the procedures may also be performed in different orders, simultaneously and/or sequentially. In several example embodiments, the steps, processes and/or procedures may be merged into one or more steps, processes and/or procedures. In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Figure 24:
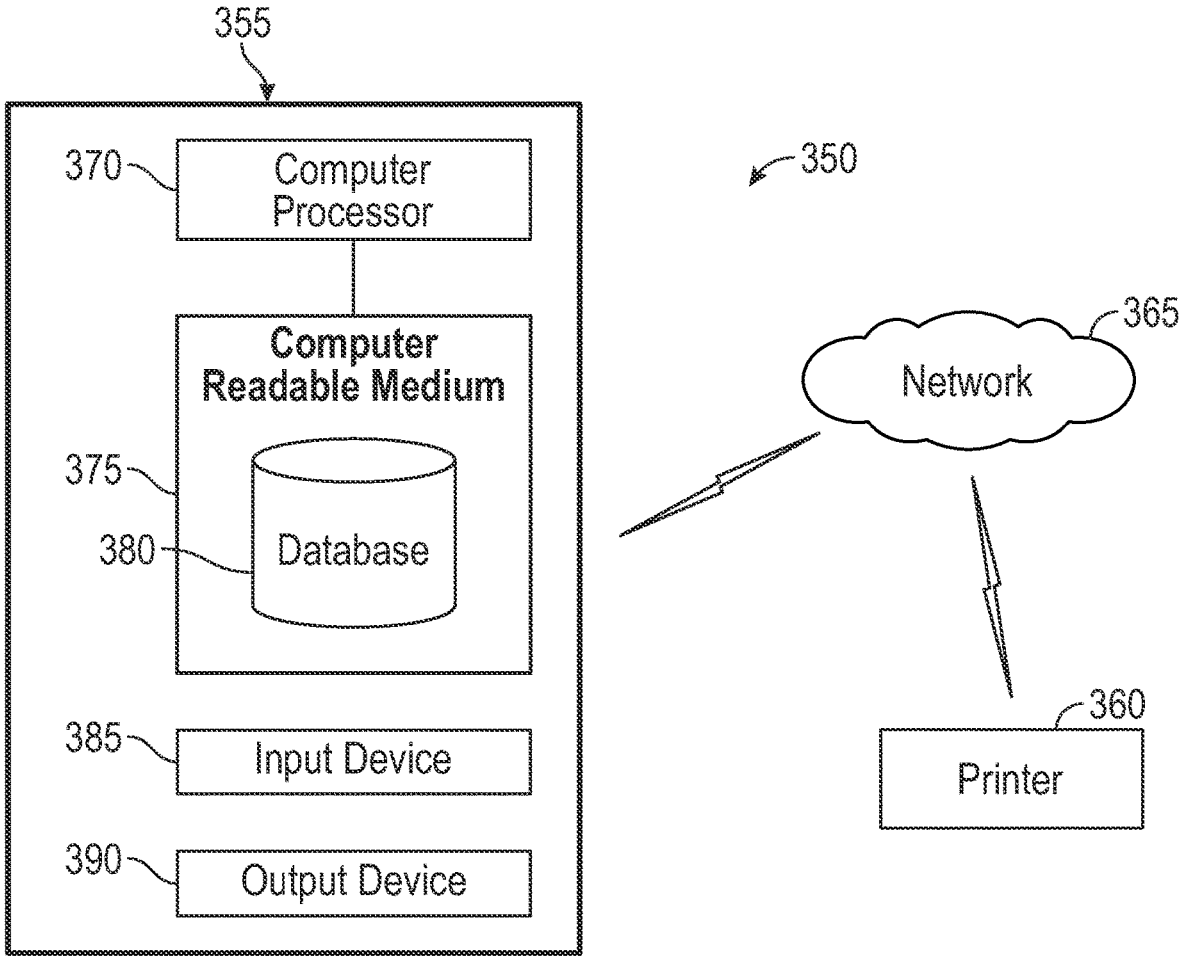
FIG. 24 illustrates an additive manufacturing system, according to an example embodiment.

In an example embodiment and as shown in FIG. 24, a down-hole tool printing system 350 includes one or more computers 355 and a printer 360 that are operably coupled together, and in communication via a network 365. In one or more example embodiments, the barrel slip 100 and/or the barrel slip 100' may be manufactured using the downhole tool printing system 350. In one or more example embodiments, the one or more computers 355 include a computer processor 370 and a computer readable medium 375 operably coupled thereto. In one or more example embodiments, the computer processor 370 includes one or more processors. Instructions accessible to, and executable by, the computer processor 370 are stored on the computer readable medium 375. A database 380 is also stored in the computer readable medium 375. In one or more example embodiments, the computer 355 also includes an input device 385 and an output device 390. In one or more example embodiments, web browser software is stored in the computer readable medium 375. In one or more example embodiments, three-dimensional modeling software is stored in the computer readable medium. In one or more example embodiments, software that includes advanced numerical methods for topology optimization, which assists in determining optimum chamber shape, chamber size distribution, and chamber density distribution or other topological features in the barrel slip 100 and/or the barrel slip 100', is stored in the computer readable medium. In one or more example embodiments, software involving finite element analysis and topology optimization is stored in the computer readable medium 375. In one or more example embodiments, any one or more constraints are entered in the input device 385 such that the software aids in the design on the barrel slip 100 and/or the barrel slip 100' in which specific portions of the body of the barrel slip 100 and/or the barrel slip 100' remain solid (i.e., no chambers are formed). In one or more example embodiments, the input device 385 is a keyboard, mouse, or other device coupled to the computer 355 that sends instructions to the computer 355. In one or more example embodiments, the input device 385 and the output device 390 include a graphical display, which, in several example embodiments, is in the form of, or includes, one or more digital displays, one or more liquid crystal displays, one or more cathode ray tube monitors, and/or any combination thereof. In one or more example embodiments, the output device 390 includes a graphical display, a printer, a plotter, and/or any combination thereof. In one or more example embodiments, the input device 385 is the output device 390, and the output device 390 is the input device 385. In several example embodiments, the computer 355 is a thin client. In several example embodiments, the computer 355 is a thick client. In several example embodiments, the computer 355 functions as both a thin client and a thick client. In several example embodiments, the computer 355 is, or includes, a telephone, a personal computer, a personal digital assistant, a cellular telephone, other types of telecommunications devices, other types of computing devices, and/or any combination thereof. In one or more example embodiments, the computer 355 is capable of running or executing an application. In one or more example embodiments, the application is an application server, which in several example embodiments includes and/or executes one or more web-based programs, Intranet-based programs, and/or any combination thereof. In one or more example embodiments, the application includes a computer program including a plurality of instructions, data, and/or any combination thereof. In one or more example embodiments, the application written in, for example, Hypertext Markup Language (HTML), Cascading Style Sheets (CSS), JavaScript, Extensible Markup Language (XML), asynchronous JavaScript and XML (Ajax), and/or any combination thereof.

In one or more example embodiments, the printer 360 is a three-dimensional printer. In one or more example embodiments, the printer 360 includes a layer deposition mechanism for depositing material in successive adjacent layers; and a bonding mechanism for selectively bonding one or more materials deposited in each layer. In one or more example embodiments, the printer 360 is arranged to form a unitary printed body by depositing and selectively bonding a plurality of layers of material one on top of the other. In one or more example embodiments, the printer 360 is arranged to deposit and selectively bond two or more different materials in each layer, and wherein the bonding mechanism includes a first device for bonding a first material in each layer and a second device, different from the first device, for bonding a second material in each layer. In one or more example embodiments, the first device is an ink jet printer for selectively applying a solvent, activator or adhesive onto a deposited layer of material. In one or more example embodiments, the second device is a laser for selectively sintering material in a deposited layer of material. In one or more example embodiments, the layer deposition means includes a device for selectively depositing at least the first and second materials in each layer. In one or more example embodiments, any one of the two or more different materials may be ABS plastic, PLA, polyamide, glass filled polyamide, stereolithography materials, silver, titanium, steel, wax, photopolymers, polycarbonate, and a variety of other materials. In one or more example embodiments, the printer 360 may involve fused deposition modeling, selective laser sintering, and/or multi jet modeling. In operation, the computer processor 370 executes a plurality of instructions stored on the computer readable medium 375. As a result, the computer 355 communicates with the printer 360, causing the printer 360 to manufacture the barrel slip 100 and/or the barrel slip 100' or at least a portion thereof. In one or more example embodiments, manufacturing the barrel slip 100 and/or the barrel slip 100' using the system 350 results in an integrally formed barrel slip 100 and/or the barrel slip 100'.

In several example embodiments, the network 365, and/or one or more portions thereof, may be designed to work on any specific architecture. In one or more example embodiments, one or more portions of the network 365 may be executed on a single computer, local area networks, client-server networks, wide area networks, internets, hand-held and other portable and wireless devices and networks.

In one or more example embodiments, the instructions may be generated, using in part, advanced numerical method for topology optimization to determine optimum chamber shape, chamber size and distribution, and chamber density distribution for the plurality of chambers 245, the shape of the gaps 210, or other features.

During operation of the system 350, the computer processor 370 executes the plurality of instructions that causes the manufacture of the barrel slip 100 and/or the barrel slip 100' using additive manufacturing. Thus, the barrel slip 100 and/or the barrel slip 100' is at least partially manufactured using an additive manufacturing process. Manufacturing the barrel slip 100 and/or the barrel slip 100' via machining forged billet stock or using multi-axis milling processes often limits the geometries and design of the barrel slip 100 and/or the barrel slip 100'. Thus, with additive manufacturing, complex geometries—such as internal chambers 245—are achieved or allowed, which results in an improved barrel slip. In one or more example embodiments, the use of three-dimensional, or additive, manufacturing to manufacture downhole equipment, such as the barrel slip 100 and/or the barrel slip 100', will allow increased flexibility in the strategic placement of material to retain strength in one direction but reduce strength, or weaken the slip in another direction.

In some embodiments, the term "about" used herein indicates a range of −/+10% or −/+5% of a quantitative amount.

A barrel slip that comprises a radially expandable barrel slip body that is movable from an unexpanded position to an expanded position has been disclosed according to a first aspect. According to the first aspect, the body has an outer surface that, when in the unexpanded position, defines a first radius; the first radius is associated with a first curvature; and when in the expanded position, portion(s) of the outer surface have a second curvature that is less than the first curvature.

The foregoing barrel slip embodiment may include one or more of the following elements, either alone or in combination with one another:

when in the unexpanded position, the outer surface has the first curvature;

when in the unexpanded position, portion(s) of the outer surface have the second curvature;

the second curvature is associated with an internal radius of a casing string;

the body has an internal surface that, when in the unexpanded position, defines a third radius; the third radius is associated with a third curvature; and when in the expanded position, portion(s) of the internal surface have a fourth curvature that is less than the third curvature;

when in the unexpanded position, a first plurality of teeth formed by a first portion of the outer surface is positioned at a first angle relative to a second plurality of teeth formed by a second portion of the outer surface; when in the expanded position, the first plurality of teeth is positioned at a second angle relative to the second plurality of teeth; and the second angle is less than the first angle;

the body is an integrally formed single-component body that defines: an external surface; and an internal chamber isolated from the external surface;

when in the unexpanded position, the body is an integrally formed single-component body that defines: a first anchor slip; a second anchor slip positioned in a first position relative to the first anchor slip; and a frangible connection that extends between the first anchor slip and the second anchor slip; and when in the expanded position, the second anchor slip is positioned in a second position relative to the second anchor slip; and the frangible connection is severed;

an inner surface of the body defines cones that extend along a length of the body; a portion of the inner surface defining the cones is a loading surface; and the loading surface has a variable curvature along a portion of the length of the body;

when in the unexpanded position, the body is an integrally formed single-component body defining: a first cylindrical portion; a second cylindrical portion disposed about the first cylindrical portion and positioned at a first position relative to the first cylindrical portion; and a fracture tab connecting the first cylindrical portion and the second cylindrical portion; and when in the expanded position, the fracture tab is broken and the second cylindrical portion is at a second, different position relative to the first cylindrical portion;

the first cylindrical portion is a wedge portion with an external surface forming first cones; and the second cylindrical portion comprises anchor slips and has an internal surface forming second cones that correspond with the first cones; and the barrel slip is at least partially manufactured using an additive manufacturing process.

A method of deploying a barrel slip has also been disclosed according to a second aspect. The method according to the second aspect generally includes positioning the barrel slip within a casing string when the barrel slip is in an unexpanded position; wherein the casing string has an inner surface having a first curvature; wherein the barrel slip comprises a body having an outer surface that, when in the unexpanded position, defines a second radius; and wherein the second radius is associated with a second curvature; and expanding the body from the unexpanded position to an expanded position, wherein expanding the body from the unexpanded position to the expanded position comprises engaging the outer surface of the body with the inner surface of the casing string; and wherein, when in the expanded position, portion(s) of the outer surface have the first curvature that is less than the second curvature.

The foregoing method embodiment may include one or more of the following elements, either alone or in combination with one another:

when in the unexpanded position, the outer surface has the second curvature;

when in the unexpanded position, portion(s) of the outer surface have the first curvature;

when in the unexpanded position, a first plurality of teeth formed by a first portion of the outer surface is positioned at an angle relative to a second plurality of teeth formed by a second portion of the outer surface; and wherein expanding the body from the unexpanded position to the expanded position further comprises repositioning the first plurality of teeth relative to the second plurality of teeth to reduce the angle;

wherein the body is an integrally formed single-component body that defines: an external surface; and an internal chamber isolated from the external surface;

when in the unexpanded position, the body is an integrally formed single-component body that defines: a first anchor slip; a second anchor slip positioned in a first position relative to the first anchor slip; and a frangible connection that extends between the first anchor slip and the second anchor slip; and wherein expanding the body from the unexpanded position to the expanded position further comprises: severing the frangible connection; and moving the first anchor slip relative to the second anchor slip;

when in the unexpanded position, the body is an integrally formed single-component body defining: a first cylindrical portion; a second cylindrical portion disposed about the first cylindrical portion and positioned at a first position relative to the first cylindrical portion; and a fracture tab connecting the first cylindrical portion and the second cylindrical portion; and wherein expanding the body from the unexpanded position to the expanded position further comprises: severing the fracture tab; and moving the first cylindrical portion relative to the second cylindrical portion; and the barrel slip is at least partially manufactured using an additive manufacturing process.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the example term "below" may encompass both an orientation of above and below. The apparatus may be otherwise oriented (rotated 90 degrees or at other orientations) and the spatially relative descriptors used herein may likewise be interpreted accordingly.

What is claimed is:

1. A barrel slip that comprises a radially expandable barrel slip body that is movable from an unexpanded position to an expanded position;

wherein the body includes a plurality of circumferentially spaced slip anchors, each slip anchor has an outer surface that, when the body is in the unexpanded position, defines an outer radius having a center that is circumferentially offset from outer radius centers of other slip anchors in the plurality of circumferentially spaced slip anchors;

and wherein, when the body is in the expanded position, the outer radius centers of the circumferentially spaced slip anchors converge at a common center of the body such that the body defines a circular cross section in the expanded position.

2. The barrel slip of claim 1, wherein, when in the unexpanded position, the outer surface of each of the slip anchors is radially displaced from the casing center by a radial distance less than the outer radius.

3. The barrel slip of claim 1, wherein, when in the unexpanded position, the outer surface of each of the slip anchors have a curvature associated with the circular cross section in the expanded position.

4. The barrel slip of claim 1, wherein the outer radius is associated with an internal radius of a casing string, and wherein the internal radius of the casing string has a center at the common center of the body at which the outer radius centers of the circumferentially spaced slip anchor converge.

5. The barrel slip of claim 4, wherein each slip anchor has an internal surface that, when the body is in the unexpanded position, defines an inner radius having a center that is circumferentially offset from inner centers of other slip anchors in the plurality of circumferentially spaced slip anchors and radially offset from the common center of the body at which the outer radius centers of the circumferentially spaced slip anchor converge;

and wherein, when the body is in the expanded position, the inner radius centers of the circumferentially spaced slip anchors converge at the common center of the body.

6. The barrel slip of claim 1, wherein, when in the unexpanded position, a first plurality of teeth formed by a first portion of the body is positioned at a first angle relative to a second plurality of teeth formed by a second portion of the body;

wherein, when in the expanded position, the first plurality of teeth is positioned at a second angle relative to the second plurality of teeth; and wherein the second angle is less than the first angle.

7. The barrel slip of claim 1, wherein the body is an integrally formed single-component body that defines:

an external surface defining an entire exterior surface of the body; and an internal chamber isolated from the external surface such that the internal chamber does not penetrate the external surface.

8. The barrel slip of claim 1, wherein, when in the unexpanded position, the body is an integrally formed single-component body that defines:

a first slip anchor of the plurality of slip anchors;

a second slip anchor of the plurality of slip anchors, the second slip anchor positioned in a first position relative to the first slip anchor; and a frangible connection that extends between the first slip anchor and the second slip anchor; and wherein, when in the expanded position, the second slip anchor is positioned in a second position relative to the first slip anchor; and the frangible connection is severed.

9. The barrel slip of claim 1, wherein an inner surface of the body defines cones that extend along a length of the body;

wherein a portion of the inner surface defining the cones is a loading surface; and wherein the loading surface has a variable curvature along a portion of the length of the body.

10. The barrel slip of claim 1, wherein, when in the unexpanded position, the body is an integrally formed single-component body defining:

a first cylindrical portion;

a second cylindrical portion disposed about the first cylindrical portion and positioned at a first position relative to the first cylindrical portion; and a fracture tab connecting the first cylindrical portion and the second cylindrical portion; and wherein, when in the expanded position, the fracture tab is broken and the second cylindrical portion is at a second, different position relative to the first cylindrical portion.

11. The barrel slip of claim 10, wherein the first cylindrical portion is a wedge portion with an external surface forming first cones; and wherein the second cylindrical portion comprises slip anchors of the plurality of slip anchors and has an internal surface forming second cones that correspond with the first cones.

12. The barrel slip of claim 1, wherein the barrel slip is at least partially manufactured using an additive manufacturing process.

13. A method of deploying a barrel slip, the method comprising:

positioning the barrel slip within a casing string when the barrel slip is in an unexpanded position;

wherein the casing string has an inner surface having a first curvature defining an internal radius extending from a casing center;

wherein the barrel slip comprises a body includes a plurality of circumferentially spaced slip anchors, each slip anchor having an outer surface that, when in the unexpanded position, defines an outer radius extending from an outer center that is radially offset from the casing center; and expanding the body from the unexpanded position to an expanded position, wherein expanding the body from the unexpanded position to the expanded position comprises radially displacing the slip anchors to converge the outer radius centers of the slip anchors at a common center of the body at the casing center and thereby engaging the outer surface of each of the slip anchors with the inner surface of the casing string; and wherein, when in the expanded position, the outer surface of each of the slip anchors have the first curvature of the inner surface of the casing string.

14. The method of claim 13, wherein, when in the unexpanded position, the outer surface of each of the slip anchors is radially displaced from the casing center by a radial distance less than the outer radius.

15. The method of claim 14, wherein the barrel slip is at least partially manufactured using an additive manufacturing process.

16. The method of claim 13, wherein, when in the unexpanded position, the outer surface of each of the slip anchors have the first curvature of the inner surface of the casing string.

17. The method of claim 13, wherein, when in the unexpanded position, a first plurality of teeth formed by a first portion of the body is positioned at an angle relative to a second plurality of teeth formed by a second portion of the body; and wherein expanding the body from the unexpanded position to the expanded position further comprises repositioning the first plurality of teeth relative to the second plurality of teeth to reduce the angle.

18. The method of claim 13, wherein the body is an integrally formed single-component body that defines:

an external surface defining an entire exterior surface of the body; and an internal chamber isolated from the external surface such that the internal chamber does not penetrate the external surface.

19. The method of claim 13, wherein, when in the unexpanded position, the body is an integrally formed single-component body that defines:

a first slip anchor of the plurality of slip anchors;

a second slip anchor of the plurality of slip anchors, the second slip anchor positioned in a first position relative to the first slip anchor; and a frangible connection that extends between the first slip anchor and the second slip anchor; and wherein expanding the body from the unexpanded position to the expanded position further comprises:

severing the frangible connection; and moving the first slip anchor relative to the second slip anchor.

20. The method of claim 13, wherein, when in the unexpanded position, the body is an integrally formed single-component body defining:

a first cylindrical portion;

a second cylindrical portion disposed about the first cylindrical portion and positioned at a first position relative to the first cylindrical portion; and a fracture tab connecting the first cylindrical portion and the second cylindrical portion; and wherein expanding the body from the unexpanded position to the expanded position further comprises:

severing the fracture tab; and moving the first cylindrical portion relative to the second cylindrical portion.

* * * * *